US005461198A

United States Patent [19]

Delalle

[11] Patent Number: 5,461,198

[45] Date of Patent: Oct. 24, 1995

[54] ELECTRICAL CONNECTOR

[75] Inventor: Jacques Delalle, Triel-sur-Seine, France

[73] Assignee: Raychem SA, France

[21] Appl. No.: 244,462

[22] PCT Filed: Dec. 4, 1992

[86] PCT No.: PCT/GB92/02257

§ 371 Date: Jul. 7, 1994

§ 102(e) Date: Jul. 7, 1994

[87] PCT Pub. No.: WO93/11584

PCT Pub. Date: Jun. 10, 1993

[30] Foreign Application Priority Data

Dec. 5, 1991 [GB] United Kingdom ..... 9125923

[51] Int. Cl.[6] ..... H01R 4/02; H01R 4/22; H01R 43/02

[52] U.S. Cl. ..... 174/87; 29/872; 174/84 R; 174/DIG. 8

[58] Field of Search ..... 174/87, 84 R, 174/DIG. 8; 29/872, 868

[56] References Cited

U.S. PATENT DOCUMENTS

| | | | |
|---|---|---|---|
| 2,656,204 | 10/1953 | Blomstrand | 174/87 |
| 3,440,334 | 4/1969 | Blomstrand | 174/87 |
| 3,676,574 | 7/1972 | Johansson et al. | 174/87 |
| 4,271,330 | 6/1981 | Watine et al. | 174/84 R |
| 4,288,657 | 9/1981 | Swanson | 174/87 |
| 4,454,376 | 6/1984 | Holder et al. | 174/87 |
| 4,910,179 | 7/1990 | Soni | 174/84 R |
| 5,015,512 | 5/1991 | Matsumoto | 174/84 R |
| 5,331,113 | 7/1994 | Soni et al. | 174/87 |
| 5,347,090 | 9/1994 | Cerda | 174/84 R |
| 5,378,855 | 1/1995 | Delalle | 174/87 |
| 5,393,932 | 2/1995 | Young et al. | 174/84 R |
| 5,397,858 | 3/1995 | Delalle | 174/87 |

FOREIGN PATENT DOCUMENTS 0382407 8/1990 European Pat. Off. .

*Primary Examiner*—Morris H. Nimmo
*Attorney, Agent, or Firm*—Sheri M. Novack; Herbert G. Burkard

[57] ABSTRACT

A device for forming an electrical connection between part of an elongate electrical conductor between its ends and one or more other electrical conductors comprises and electrically insulating sleeve, a metallic connecting element located within the sleeve, and a quantity of solder for forming a permanent electrical connection between the conductors. The electrically insulating sleeve and the connecting element have two open ends to allow the elongate electrical conductor to extend through them, and the connecting element has a tapering internal surface which has a screw thread to enable the other electrical conductor or conductors to be held in contact with the elongate electrical conductor by twisting the connecting element about the conductors.

13 Claims, 2 Drawing Sheets

ELECTRICAL CONNECTOR

This invention relates to electrical connectors, and especially to connectors for forming solder joints between conductors in such articles as automotive harnesses and the like.

Electrical harnesses, for example as manufactured in the automotive industry, are often quite complex. In some instances they are manufactured by forming two or more sub-assemblies of wires, terminals, connectors and any other components, and then forming electrical connection(s) between the sub-assemblies. In such a case the assembly of the harness may be controlled by computer permitting, with the aid of a monitor, the assembly operator to see schematically the lay up and to check correct build-up of the assembly at each stage of the harness manufacture. In order to enable this control process to operate the ends of the conductors of the sub-assemblies are connected, e.g. by means of spring contacts, and an electrical current or signal is passed through the assembly in order to obtain verification that the harness is correct. It is only after such verification is obtained that the clips are removed and a permanent electrical connection is formed.

A device for forming temporary and a permanent electrical connection that is suitable in such a circumstance is described in our co-pending international application No. PCT/GB91/01016, the disclosure of which is incorporated herein by reference. According to the present invention such a device is modified in order to enable electrical conductors to be connected to an intermediate part of an elongate conductor. Thus, according to one aspect, the present invention provides a device for forming an electrical connection between part of an elongate electrical conductor between its ends and one or more other electrical conductors, which comprises an electrically insulating sleeve, a metallic connecting element located within the sleeve, and a quantity of solder for forming a permanent electrical connection between the conductors, the electrically insulating sleeve and the connecting element having two open ends to allow the elongate electrical conductor to extend therethrough, and the connecting element having a tapering internal surface which has a screw thread to enable the other electrical conductor or conductors to be held in contact with the elongate electrical conductor by twisting the connection element about the conductors.

The device according to the invention may be employed to form an electrical connection in a very quick and simple manner. Thus, according to another aspect, the invention provides a method of forming a connection between part of an elongate electrical conductor between its ends and one or more other electrical conductors, which comprises:

(i) sliding a device comprising an electrically insulating sleeve and a metallic connecting element located within the sleeve along the elongate electrical conductor, the insulating sleeve and the connecting element having open ends to allow the elongate electrical conductor to extend therethrough and the connecting element having a tapering internal surface which has a screw thread;

(ii) inserting one or more other electrical conductors into one end of the sleeve and connecting element;

(iii) twisting the device about the conductors so that the connecting element holds the other conductor or conductors in contact with the elongate electrical conductor; and (iv) heating the device in order to form a solder connection between the conductors.

The device according to the invention has the advantage that the conductors can be electrically joined to form a temporary joint which is disconnectable but is able to have a high degree of dependability, in order, for example to test the connected conductors, and can then be permanently joined with no further manipulation of the joint but simply by heating the sleeve in order to melt the solder. In addition, the tapering interior of the connecting element enables bundles formed from a range of conductor sizes to be handled by the device.

In the broadest aspect of the invention the device includes a connecting element having a single tapering internal surface so that a connection can be formed with conductors having a range of sizes. However, it is possible for devices according to the invention to include connecting elements having more than one tapering internal surface. Thus, the connecting element may have an internal surface that tapers from each end thereof toward a central part of smaller diameter in order to allow one or more other electrical conductors to be inserted from each end thereof. In such a case the connecting element may be formed from a pair of parts that can be rotated with respect to each other, or it may be formed with the threads in the tapering internal surfaces being of opposite senses to each other so that conductors inserted into both ends of the connecting element can be secured by rotating the element in one direction.

The invention may be employed to form a connection to a single conductor wire, ie. an unscreened wire, but more usually it will be employed to form a connection to a central part of a screen, for example of a coaxial cable, screened twisted pair or the like. In such a case any insulation over the screen at the point of connection is removed to expose the screen, and the device is slid along the cable until the connecting element thereof is positioned over the exposed screen. In the case of a connecting element formed by coiling a wire, it is possible if the size of the device is matched correctly to that of the cable, for the insulated cable to force the smallest diameter winding of the connecting element to open slightly to a larger diameter. When the device has been slid along the cable to the exposed part of the screen the last winding of the connecting element will relax to its original size and grip the screen.

Usually the sleeve will be dimensionally recoverable, and especially dimensionally heat-recoverable, that is to say the article has a dimensional configuration that may be made substantially to change when subjected to heat treatment.

Usually these articles recover, on heating, towards an original shape from which they have previously been deformed but the term "heat-recoverable", as used herein, also includes an article which, on heating, adopts a new configuration, even if it has not been previously deformed.

In their most common form, such articles comprise a heat-shrinkable sleeve made from a polymeric material exhibiting the property of elastic or plastic memory as described, for example, in U.S. Pat. Nos. 2,027,962; 3,086,242 and 3,597,372. As is made clear in, for example, U.S. Pat. No. 2,027,962, the original dimensionally heat-stable form may be a transient form in a continuous process in which, for example, an extruded tube is expanded, whilst hot, to a dimensionally heat-unstable form but, in other applications, a preformed dimensionally heat-stable article is deformed to a dimensionally heat unstable form in a separate state.

In the production of heat-recoverable articles, the polymeric material may be cross-linked at any stage in the production of the article that will enhance the desired dimensional recoverability. One manner of producing a heat-recoverable article comprises shaping the polymeric material into the desired heat-stable form, subsequently cross-linking the polymeric material, heating the article to a temperature above the crystalline melting point or, for amorphous materials the softening point, as the case may be, of the polymer, deforming the article and cooling the article whilst in the deformed state so that the deformed state of the article is retained. In use, since the deformed state of the article is heat-unstable, application of heat will cause the article to assume its original heat-stable shape.

Any material to which the property of dimensional recoverability may be imparted may be used to form the sleeve. Preferred materials include low, medium or high density polyethylene, ethylene copolymers, e.g. with alpha olefins such as 1-butene or 1-hexene, or vinyl acetate, polyamides or fluoropolymers, e.g. polytetrafluoroethylene, vinylidine fluoride or ethylenetetrafluoroethylene copolymer.

The fact that the ends of the conductors are enclosed in the connection element will also reduce the risk of any strands of the conductors piercing the sleeve during recovery thereof. Also, the conducting element can act as a heat-sink thereby preventing overheating of the device during recovery.

At least in the broadest aspect of the invention the connecting element may generally have any form although it is preferred for it to be formed by coiling a piece of wire into a tapering coil so that the windings form the screw thread. Preferably the internal surface of the connecting element is at least partly conical, for example it may be conical or frusto-conical. If the connecting element is formed from a wire, it can grip the bundle of conductors introduced therein due to the resilience of the wire and the fact that it will be enlarged radially to some extent by the introduction of the bundle. However, in one advantageous form of device it has been radially expanded from its relaxed state during manufacture of the device and to be retained in its expanded state so that it will radially contract, or attempt radially to contract, when the permanent connection is formed. Thus, for example, the spring may be held out against its resilient recovery forces by the sleeve or by the solder, so that softening of the sleeve or melting of the solder will allow the spring to recover. For example, a boss may be formed on the internal surface of the sleeve or on the internal surface of the solder which will disappear when the device is heated. The degree of expansion need not be great, for example it may be not more than 5% or even not more than 2%, since it may be desirable that the coil remains in contact with the solder element when the device is heated.

The wire may be formed with a circular cross-section, although it is preferred for the wire to have a relatively sharp ridge along its length, e.g. formed by cold drawing or cold rolling, which, when the wire has been coiled, is directed toward the interior of the coil in order to form the screw thread. In particular it is advantageous for the wire to be formed with a polygonal cross-section and especially a square or rhombic cross-section. The wire may be formed from any appropriate metal or metal alloy, but preferably is formed from copper, and especially from copper having substantially the same purity as that conventionally employed for electrical conductors.

As mentioned above, the device includes a quantity of solder, ie. a quantity of soft solder as distinct from brazing material, for forming a permanent solder connection. The solder may, for example, simply be in the form of an $Sn_{63}Pb_{37}$ eutectic composition which will melt as the device is heated and the sleeve recovers, or more than one solder composition having differing melting points may be employed, as described in International Application No. WO88/09068. In this form of device, melting of the higher melting point component, e.g. $Sn_{96.5}Ag_{3.5}$ eutectic will provide a visual indication that the device has been heated sufficiently to melt the lower melting point composition and to form a satisfactory solder joint. If desired the lower melting point solder may be a non-eutectic composition and, for example as described in International Application No. PCT/GB90/00234, the higher and lower melting point solder compositions may together form a eutectic composition. For example, a non-eutectic $Sn_{60}Pb_{40}$ lower melting point component may be employed with a higher melting point component formed from pure tin in relative amounts that an $Sn_{63}Pb_{37}$ eutectic is formed. The disclosures of these two patent applications are incorporated herein by reference. An advantage of employing a two component solder, and especially a tin, $Sn_{60}Pb_{40}$ combination is that it reduces the possibility of "wicking" that is to say, travel of the solder along the conductors and away from the joint area due to capillary action by the stranded conductors, which can be caused by prolonged heating of the device.

The solder may be positioned anywhere where it will be able to flow into the connecting element to form a solder joint. The solder may be employed in the form of a ring or in any other form for example a ball, and may be disposed symmetrically about the sleeve axis or offset from it. The solder element may, for instance, be located at the smaller diameter end of the connecting element in which case it may be in the form of a ball or plug, or it may be located in the region of a large diameter end of the connecting element, for example in the form of a ring. Preferably the solder is in the from of an element that surrounds the connecting element, especially where the connecting element is in the form of a coil so that the fused solder can flow through the windings of the coil to the interior thereof. More than one quantity of solder may be employed, for example where the connecting element has more than one tapering internal surface for forming a splice.

Although it is not essential, the sleeve will normally be provided with one or more sealant inserts in order to reduce or prevent ingress of moisture into the connection. For example the sleeve may contain an insert, e.g. in the form of a ring, of a fusible polymeric material which will melt when the device is heated to melt the solder. Materials that may be used to form the fusible insert include alkylene homo- and copolymers, e.g. polyethylene or ethylene-vinyl acetate copolymer, polyamides e.g. those based on dimer diamines, and polyesters.

Several devices in accordance with the present invention will now be described by way of example with reference to the accompanying drawings in which.

Figure 1:
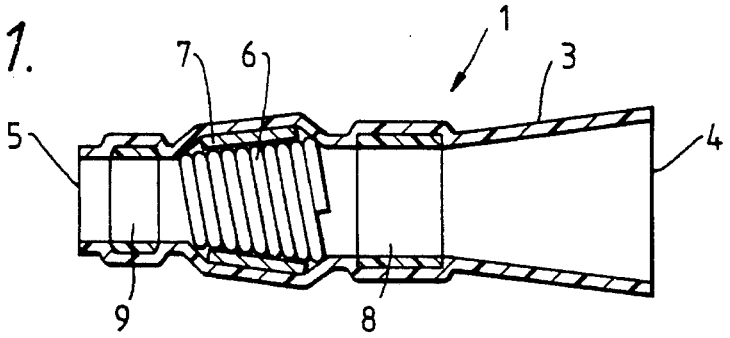
FIG. 1 is a section through one form of device according to the invention.

Referring initially to FIGS. 1 to 4, a device 1 for forming an electrical connection between the braid of a screened cable 2 comprises a dimensionally heat-recoverable sleeve 3 having two open ends 4 and 5. The sleeve contains a connecting element 6 that has been formed from a hard tempered copper wire by coiling it to form a tapering helix. The wire has a cross-section in the form of a sector of a circle and it is oriented so that the circular side of the wire forms the exterior surface of the connecting element. A strip of solder 7 is located around the connecting element and pressed onto it to form the solder into a frusto-conical shape that accommodates itself to the outer surface of the connecting element.

The sleeve 3 is formed from cross-linked polyvinylidine fluoride and contains a pair of fusible rings 8 and 9, the rings being located at opposite ends of the connecting element 6. The rings 8 and 9 are formed from uncrosslinked polyethylene or may be formed from another plastics material that will produce a good seal to an specific cable jacket.

Figure 2:
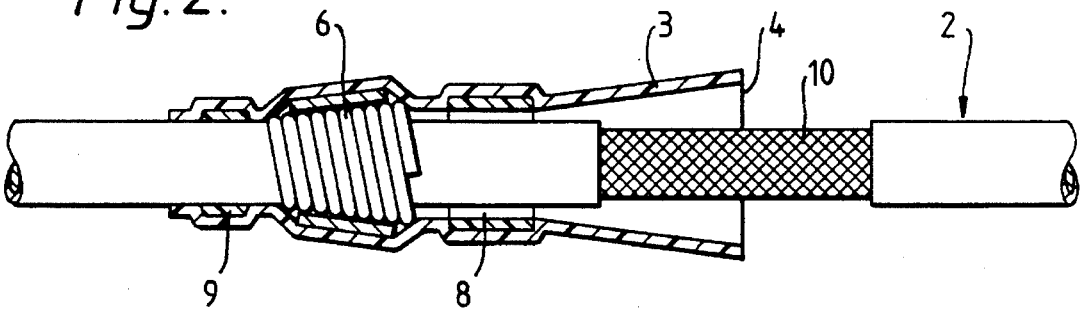
FIG. 2 is a section through the device during installation on a coaxial cable.
Figure 3:
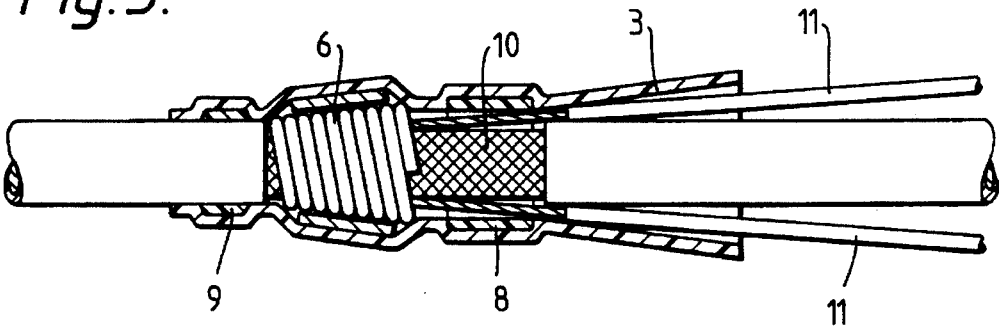
FIG. 3 is a section through the device at a later stage during installation.
Figure 4:
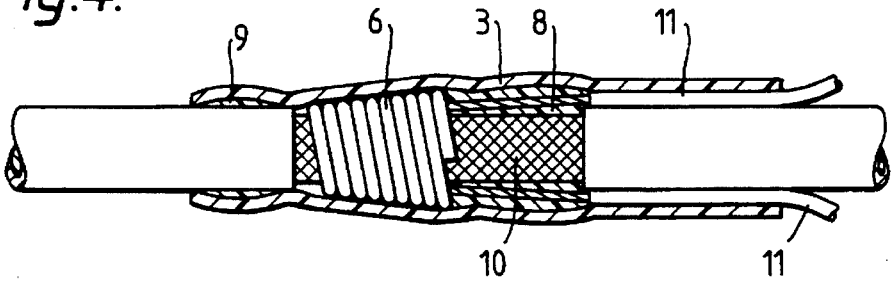
FIG. 4 is a section through the device after completion of the connection.

In order to form an electrical connection to the braid of a shielded cable 2 a portion of the jacket is removed by centre stripping to expose the braid 10. The device 1 is then slipped over one end of the cable and slid toward the exposed portion of braid 10 as shown in FIG. 2. The size of the device 1 should be chosen so that the smaller diameter end of the connecting element 6 is very slightly smaller than the diameter of the braid so that the smaller diameter end of the connecting element is forced to enlarge as it is pushed over the cable jacket. When the device is located over the exposed braid 10 the connecting element 6 will return to its original shape and the smaller diameter end will grip the braid. A number of insulated wires 11 whose ends have been stripped of insulation are then inserted into the open end 4 of the sleeve 3 until their stripped ends are positioned within the connecting element as shown in FIG. 3. The device 1 is then twisted about the cable 2 and wires 11 so that the screw thread formed by the wire of the connecting element bites into the exposed conductors of the wires 11 and firmly grips the conductors. The electrical performance of the harness formed from the cable 2 and wires 11 can then be tested and afterwards the device 1 can be heated for example by means of a hot-air gun or an infrared lamp to cause the solder 7 to flow and form a permanent solder connection between the braid 10 and the wires 11. When the device 1 is heated the fusible rings 8 and 9 will also melt and flow to seal the device against ingress of water into either end thereof.

Figure 5:
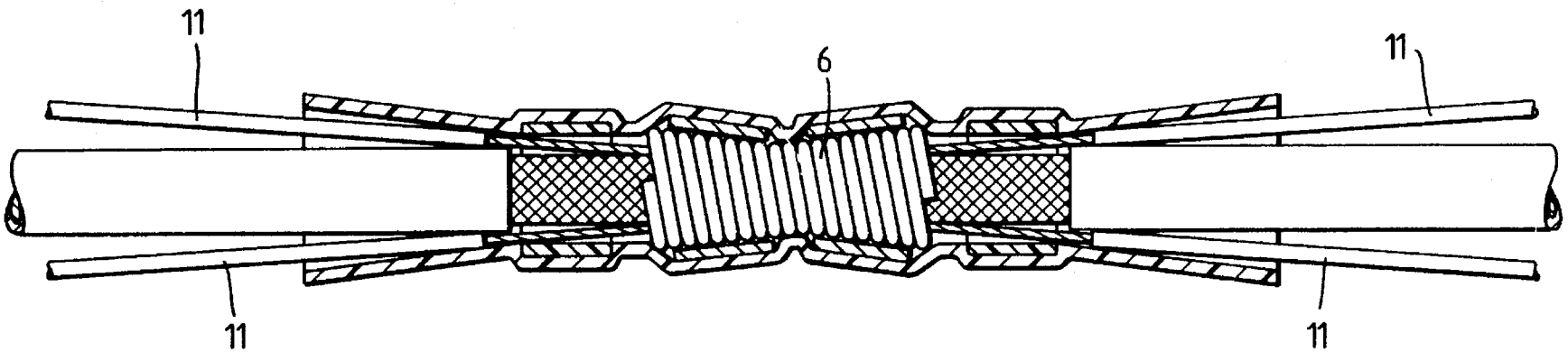
FIG. 5 is a section through a second form of device according to the invention during installation.

FIG. 5 shows a second form of device in which the connecting element 6 has two frusto-conical halves which are joined at their smaller diameter ends to form a single element having a narrow waist. In this case the element is formed from a single piece of wire although it is possible to form the element 6 so that one half is rotatable with respect to the other. As shown wires 11 can be inserted into both ends of the connecting element 6 and can be gripped by rotating the device 1 about the cable and wires. The wire, forming the connecting element 6 is wound in opposite senses in different halves of the element so that rotation of the device about the cable 2 and wires 11 will cause the wires in both halves of the element to be gripped.

I claim:

1. A device for forming an electrical connection between part of an elongate electrical conductor between its ends and one or more other electrical conductors, which comprises an electrically insulating sleeve, a metallic connecting element located within the sleeve, and a quantity of solder for forming a permanent electrical connection between the conductors, the electrically insulating sleeve and the connecting element having two open ends to allow an elongate electrical conductor to extend therethrough, and the connecting element having a tapering internal surface which has a screw thread to enable the other electrical conductor or conductors to be held in contact with the elongate electrical conductor by twisting the connection element about the conductors.

2. A device as claimed in claim 1, wherein the sleeve is dimensionally heat-recoverable.

3. A device as claimed in claim 1, wherein the connecting element is formed by coiling a piece of wire into a tapering coil.

4. A device as claimed in claim 3, wherein the coil has been radially expanded from its relaxed state and is retained in its expanded state so that it will radially contract, or attempt radially to contract when the permanent connection is formed.

5. A device as claimed in claim 3, wherein the wire has a relatively sharp ridge along its length which is directed toward the interior of the coil in order to form the screw thread.

6. A device as claimed in claim 3, wherein the wire has a polygonal cross-section.

7. A device as claimed in claim 1, wherein the connecting element is formed from copper.

8. A device as claimed in claim 1, wherein the solder is formed from a plurality of compositions that have differing melting points.

9. A device as claimed in claim 1, wherein the solder is in the form of an element, is located around the connecting element.

10. A device as claimed in claim 9, wherein the solder element is frusto-conical in shape and sits in contact with the connecting element.

11. A device as claimed in claim 9, wherein the connecting element has an internal surface that tapers from each end thereof toward a central part of smaller diameter in order to allow one or more other electrical conductors to be inserted from each end thereof.

12. A device as claimed in claim 1, wherein the sleeve contains one or more inserts of a fusible polymeric material in order to form a seal against ingress of moisture.

13. A method of forming a connection between part of an elongate electrical conductor between its ends and one or more other electrical conductors, which comprises:

(i) sliding a device comprising an electrically insulating sleeve and a metallic connecting element located within the sleeve along the elongate electrical conductor, the insulating sleeve and the connecting element having open ends to allow the elongate electrical conductor to extend therethrough and the connecting element having a tapering internal surface which has a screw thread;

(ii) inserting one or more other electrical conductors into one end of the sleeve and connecting element;

(iii) twisting the device about the conductors so that the connecting element holds the other conductor or conductors in contact with the elongate electrical conductor; and (iv) heating the device in order to form a solder connection between the conductors.

* * * * *

UNITED STATES PATENT AND TRADEMARK OFFICE

CERTIFICATE OF CORRECTION

PATENT NO. : 5,461,198

DATED : October 24, 1995

INVENTOR(S) : DELALLE

It is certified that error appears in the above-indentified patent and that said Letters Patent is hereby corrected as shown below:

Column 5, Line 60, replace "an", by --the--.

Signed and Sealed this

Fifth Day of March, 1996

*Attest:*

*Attesting Officer*

BRUCE LEHMAN

*Commissioner of Patents and Trademarks*